United States Patent [19]

Lührsen et al.

[11] Patent Number: 4,923,225

[45] Date of Patent: May 8, 1990

[54] ASSEMBLY FOR CONNECTING A METAL MEMBER TO A CERAMIC REFRACTORY MEMBER

[75] Inventors: Ernst Lührsen, Bad Schwalbach; Siegfried Pohl, Heidenroth-Springen; Albert Ott, Waldems-Wüstems; Wilhelm Parbel, Neukirchen-Vluyn; Karl Baum, Wiesbaden, all of Fed. Rep. of Germany

[73] Assignee: Didier-Werke AG, Wiesbaden, Fed. Rep. of Germany

[21] Appl. No.: 250,139

[22] Filed: Sep. 27, 1988

[30] Foreign Application Priority Data

Oct. 21, 1987 [DE] Fed. Rep. of Germany ..... 3735546

[51] Int. Cl.[5] ..... F16L 41/04

[52] U.S. Cl. ..... 285/189; 222/603; 222/607; 285/911; 285/357; 411/258; 411/178; 266/236; 403/30; 403/268

[58] Field of Search ..... 285/189, 911, 357; 222/603, 607; 266/236; 403/30, 267, 268, 28, 404; 411/178, 82, 258, 23

[56] References Cited

U.S. PATENT DOCUMENTS

| | | | |
|---|---|---|---|
| 797,632 | 8/1905 | Stroh | 411/178 |
| 3,561,098 | 2/1971 | Voelker | 403/267 |
| 3,651,998 | 3/1972 | Rocher | 222/603 |
| 4,440,534 | 4/1984 | La Bate | 411/82 |

FOREIGN PATENT DOCUMENTS

| | | | |
|---|---|---|---|
| 1475670 | 1/1969 | Fed. Rep. of Germany | 285/911 |
| 419358 | 11/1947 | Italy | 285/357 |
| 36045 | 2/1982 | Japan | 222/603 |
| 2179573 | 3/1987 | United Kingdom | 222/603 |

*Primary Examiner*—Randolph A. Reese
*Assistant Examiner*—Carol I. Bordas
*Attorney, Agent, or Firm*—Wenderoth, Lind & Ponack

[57] ABSTRACT

A member formed of ceramic refractory material has therein an opening. A metal coupling member for attaching a metal member such as a rod or a tube, to the refractory member has an externally threaded portion extending into the opening in the refractory member. The coupling member has a head extending radially outwardly beyond the threads of the threaded portion and embedded in the refractory member. The opening in the refractory member may be internally threaded to receive the threads of the threaded portion of the coupling member.

13 Claims, 1 Drawing Sheet

ASSEMBLY FOR CONNECTING A METAL MEMBER TO A CERAMIC REFRACTORY MEMBER

BACKGROUND OF THE INVENTION

The present invention relates to an arrangement for joining a metal member, particularly a rod or a tube, for example a gas connection tube, to a molded body of fireproof or refractory ceramic material, for example, an immersion spout, wherein a metal coupling member for supporting the metal member is arranged or attached to the refractory body.

In a known immersion spout formed of refractory material, a metal coupling is inserted into a bore in the immersion spout for connecting thereto a gas connection tube. The coupling is welded to an annular metal jacket that surrounds the immersion spout, thereby joining the coupling to the immersion spout. This arrangement however has the disadvantage that the annular metal jacket expands to a greater degree than does the refractory material of the immersion spout upon use of the immersion spout at elevated temperatures. Accordingly, the joint between the connection tube and the immersion spout becomes loosened. Another disadvantage of this known arrangement is that the annular metal jacket protrudes or extends outwardly beyond the outer dimension of the immersion spout. The metal jacket thus hinders the extension of the immersion spout through a perforated brick or nozzle brick, for example of a mold. Theoretically, this could be prevented by reducing the wall thickness of the immersion spout by an amount corresponding to the thickness of the metal jacket, or at least by an amount sufficient to enable the immersion spout and metal jacket to extend through a hole of particular diameter of a perforated brick. However, such wall thickness reduction would be undesirable.

SUMMARY OF THE INVENTION

Accordingly, it is an object of the present invention to provide an assembly or arrangement whereby it is possible to connect a metal member, such as a gas connection tube, to a refractory member, such as an immersion spout, while overcoming the above and other prior art disadvantages.

It is a more particular object of the present invention to provide such an arrangement or assembly whereby a metal coupling member remains firmly connected to the molded body of refractory material, in spite of use of the assembly at elevated temperatures and in spite of differences in expansion between the metal coupling member and the refractory material of the molded body, and whereby the coupling member does not protrude outwardly beyond the outer surface of the body.

These objects are achieved in accordance with the present invention in that a member of ceramic refractory material has formed therein an opening, and means for attaching a metal member to the refractory member includes a metal coupling member having an externally threaded portion extending into the opening in the refractory member and a head extending radially outwardly beyond the threads of the threaded portion and embedded in the refractory member. The threaded portion of the metal coupling member can have a generally cylindrical or conical shape. The threads of the threaded portion of the coupling member can have a shape and inclination similar to those employed in conventional wood screws. The outer end of the opening in the refractory member can be recessed, preferably with a conical recess, and the head fits in the recess, and preferably is complementarily conically shaped.

The metal coupling member of the present invention will not become loosened from the refractory member, even at highly elevated temperatures, such as 1,000° C., to which the refractory member and thus also the coupling member are exposed. The coupling member also does not protrude beyond the outer circumference or surface of the refractory member, such that the coupling member will not prevent insertion of the refractory member, such as when in the form of an immersion spout, through an opening, such as the hole of a perforated brick. With the metal coupling member of the present invention it is possible to connect a metal member to be joined to a molded body of refractory material in a very simply manner. Particularly, it is possible, for example, to connect a gas connection tube to the coupling member by threading the end of the connection tube into an internally threaded bore extending into or through the metal coupling member.

The inner surface of the refractory member defining the opening therein and the outer surface of the threaded portion of the coupling member define therebetween an annular gap having a dimension such that at room temperature the threads of the threaded portion of the coupling member just contact or engage the inner surface of the refractory member, and at elevated operating temperatures of the assembly the greater expansion of the metal coupling member than of the refractory material is accommodated by such gap. As a result of this feature, the greater expansion of the metal coupling member at elevated temperatures will not cause the thus expanded coupling member to crack the molded body of refractory material. A refractory cement or adhesive may be provided in the annular gap between the threaded portion of the coupling member and the wall or surface defining the hole in the refractory member, and such cement or adhesive may be extended to fit between the head of the coupling member and the recessed outer end of the opening in the refractory member. On the one hand, such refractory cement or adhesive improves the required seal between the coupling member and the refractory member, and on the other hand aids in securing the threaded portion of the coupling member in the opening in the refractory member.

The application of the present invention is not intended to be limited to immersion spouts. Rather, the present invention can be applied when any metal member, particularly a metal tube or rod, is to be connected to a molded body of a ceramic refractory material.

BRIEF DESCRIPTION OF THE DRAWINGS

Other objects, features and advantages of the present invention will be apparent from the following detailed description of a preferred embodiment thereof, with reference to the accompanying drawings, wherein.

DETAILED DESCRIPTION OF THE INVENTION

Figure 1:
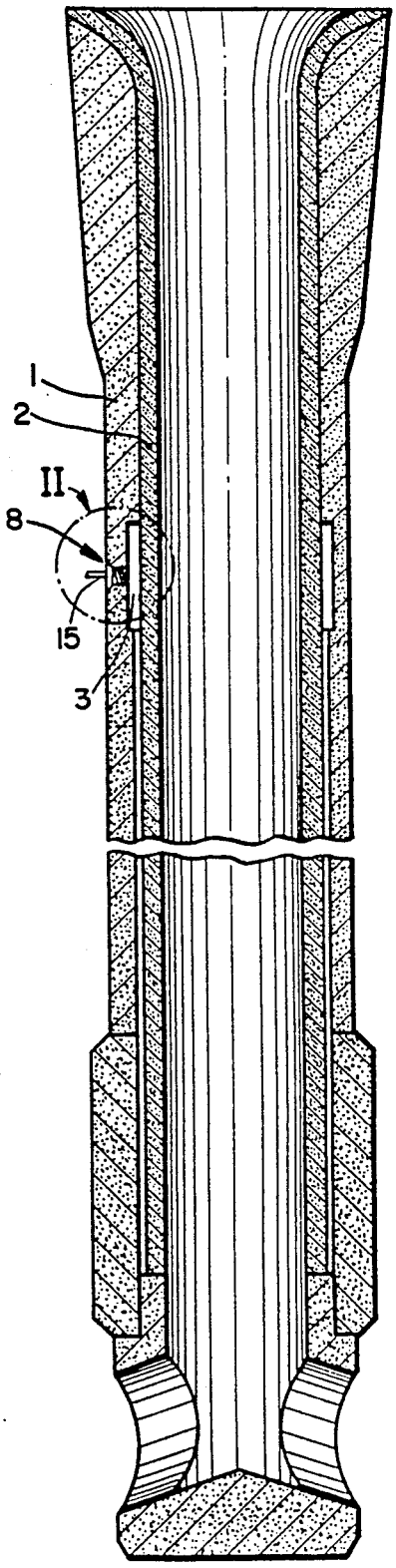
FIG. 1 is a longitudinal cross section through an immersion spout equipped with a metallic coupling member in accordance with the present invention.
Figure 2:
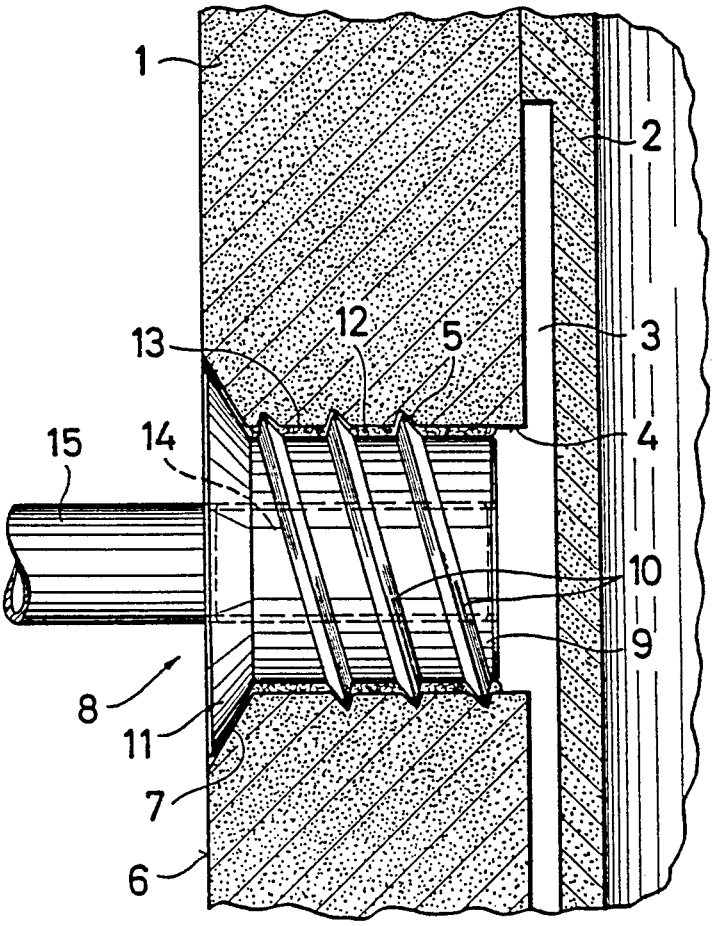
FIG. 2 is an enlarged cross section of area II in FIG. 1.

In FIG. 1 there is illustrated an immersion spout 1 of refractory ceramic material and having an internal refractory jacket 2. Between spout 1 and inner jacket 1 is a gas distribution space 3. These features in and of themselves are intended to be conventional and do not form or involve the novel features of the present invention. An opening 4 extends through spout 1 to open into the space 3, and the surface of the spout 1 defining opening 4 is internally threaded as indicated by inner threads 5. The outer end of opening 4, on outer surface 6 of spout 1, is provided with a conical recess 7. Opening 4, inner threads 5 and recess 7 can be molded into the immersion spout upon production thereof, or can be formed by machining operations after completion of molding of the immersion spout.

A metal coupling member 8 is inserted or extended into opening 4. Coupling member 8 has an externally threaded portion 9 including outer threads 10 and a conically shaped outer head 11 that extends radially outwardly from threaded portion 9 beyond outer threads 10. The largest diameter of head 11 thus is greater than the largest diameter of threaded portion 9. Preferably, the outer threads 10 may correspond in type and inclination to those of conventional wood screws. For example, one preferred thread arrangement would be similar to the commercially available RAMPA-Muffen manufactured by Fatscher and Co., KG of Mainz-Mombach, Federal Republic of Germany. Threaded portion 9, and also opening 4, can have a cylindrical shape or a conical shape.

The outer threads 10 fit into inner threads 5 of opening 4. However, between the smallest diameter of threaded portion 9 and the inner wall defining opening 4 is provided an annular gap 12 having dimensions such that at room temperature the threads 10 of threaded portion 9 just engage inner surfaces of opening 4. However, upon operation at highly elevated temperatures, the metal material of coupling member 8 will expand by a greater extent than will the refractory material of spout 1. The dimensions of gap 12 are such that this greater degree of expansion of coupling element 8 is accommodated, thereby preventing cracking of the refractory material of spout 1. A refractory cement or adhesive 13 may be provided in annular gap 12 and/or between head 11 and recess 7. Such refractory cement or adhesive operates both to secure the coupling member 8 in opening 4 and also for providing a seal therebetween.

Head 11 tightly contacts the surface defining recess 7, or a refractory cement or adhesive therebetween. The outer surface of head 11 extends flush with the outer surface 6 of spout 1.

Coupling element 8 has extending therethrough an internally threaded bore 14 into which may be threaded an end of a gas connection tube 15 of a metal material. In this manner, the gas connection tube 15 is attached to refractory immersion spout 1 in a solid and sealed manner and can distribute gas to space 3.

Although the present invention has been described and illustrated with respect to preferred features thereof, it is to be understood that various modifications and changes may be made to the specifically described and illustrated features without departing from the scope of the present invention.

We claim:

1. An assembly comprising:

a member of ceramic refractory material having therein an opening; and means for attaching a metal member to said refractory member, said attaching means comprising a metal coupling member having a longitudinal axis, an externally threaded portion l extending into said opening and a head, said head extending radially outwardly beyond the threads of said threaded portion relative to said longitudinal axis, and said heated being embedded in said refractory member.

2. An assembly as claimed in claim 1, wherein said threads of said threaded portion have a shape and incline similar to wood screws.

3. An assembly as claimed in claim 1, wherein an outer end of said opening in said refractory member has a conical recess, and said head is shaped conically and fits in said recess.

4. An assembly as claimed in claim 3, further comprising a refractory cement or adhesive between the inner surface of said conical recess and the outer surface of said conical head.

5. An assembly as claimed in claim 1, wherein an outer surface of said head extends flush with an outer surface of said refractory member.

6. An assembly as claimed in claim 1, wherein at least one inner surface of said refractory member defining said opening and at least one outer surface of said threaded portion define therebetween an annular gap having a dimension such that at room temperature said threads of said threaded portion just engage said inner surface and at elevated operating temperatures of said assembly greater expansion of said metal coupling member than of said refractory material is accommodated by said gap.

7. An assembly as claimed in claim 6, further comprising a refractory cement or adhesive positioned in said gap.

8. An assembly as claimed in claim 7, wherein said refractory cement or adhesive also is positioned between said head and said refractory member.

9. An assembly as claimed in claim 1, wherein said opening is internally threaded and said threads of said threaded portion are threaded into internal threads of said opening.

10. An assembly as claimed in claim 1, wherein said metal coupling member further includes means for connection to the metal member.

11. An assembly as claimed in claim 10, wherein said connection means comprises an internally threaded bore extending into said metal coupling member.

12. An assembly as claimed in claim 1, wherein said refractory member comprises a molded member.

13. An assembly as claimed in claim 1, wherein said refractory member comprises an immersion spout, said opening extends through a wall of said immersion spout, and said metal coupling member attaches a metal gas connection tube to said immersion spout.

* * * * *